US006027311A

United States Patent [19]

Hill et al.

[11] Patent Number: 6,027,311

[45] Date of Patent: Feb. 22, 2000

[54] ORIFICE CONTROLLED BYPASS SYSTEM FOR A HIGH PRESSURE AIR COMPRESSOR SYSTEM

[75] Inventors: Aaron Leif Hill; Dean J. Cottle, both of Erie, Pa.; Anthony Holmes Furman, Scotia, N.Y.

[73] Assignee: General Electric Company, Erie, Pa.

[21] Appl. No.: 08/946,540

[22] Filed: Oct. 7, 1997

[51] Int. Cl.[7] ..... F04B 49/00

[52] U.S. Cl. ..... 417/53; 417/307; 417/244; 165/103

[58] Field of Search ..... 417/53, 307, 244; 62/80; 303/84.1; 165/103

[56] References Cited

U.S. PATENT DOCUMENTS

| | | | |
|---|---|---|---|
| 2,209,097 | 7/1940 | Villette | 165/103 |
| 4,237,696 | 12/1980 | Coblentz | 62/93 |
| 5,106,270 | 4/1992 | Goettel et al. | 417/243 |
| 5,307,865 | 5/1994 | Inagaki et al. | 165/41 |

*Primary Examiner*—Timothy S. Thorpe
*Assistant Examiner*—Cheryl J. Tyler
*Attorney, Agent, or Firm*—Jill M. Breedlove; Douglas E. Stoner

[57] ABSTRACT

An apparatus for supplying compressed air to air operated elements of a locomotive includes an air compressor, an aftercooler coupled for receiving compressed air from the compressor, a cooling fan for blowing ambient air onto the aftercooler for reducing the temperature of the compressed air, whereby moisture in the compressed air forms condensation which is discharged from the compressor during normal operation of the aftercooler. A bypass system shunts the compressed air from the compressor around the aftercooler when the condensation freezes in the aftercooler passages and blocks normal air flow. The bypass system includes an orifice of a size selected to create a pressure drop which is greater than a pressure drop across the aftercooler when air flow through the aftercooler is not inhibited by blockage whereby air flow from the compressor normally passes through the aftercooler and bypasses the bypass system.

10 Claims, 1 Drawing Sheet

ORIFICE CONTROLLED BYPASS SYSTEM FOR A HIGH PRESSURE AIR COMPRESSOR SYSTEM

This invention relates to air compressor systems used in uncontrolled temperature environments and requiring aftercoolers to cool and remove moisture from compressed air. In particular, the invention relates to air compressor systems used in railway locomotives which use ambient air cooled aftercoolers which are subject to freezing during operation in ambient temperatures below the freezing point of water.

BACKGROUND OF THE INVENTION

Air compressor systems are used on railway locomotives to develop compressed air for operating various elements of a locomotive and in particular for supplying compressed air for operating air braking equipment. The typical system includes a two-stage compressor with an intercooler between the stages, an aftercooler connected to receive compressed air from a high pressure stage of the compressor, a shrouded fan to force ambient cooling air over the intercooler and aftercooler, and an air reservoir connected for receiving the cooled compressed air from the aftercooler. The aftercooler is required to lower the temperature of the compressed air since the elevated temperature caused by compression can reach levels that may cause damage to the braking equipment or other equipment to which the air is being supplied. In addition, the higher temperature compressed air entrains more moisture which precipitates out as condensation as the air is cooled and needs to be removed from the air in order to protect the air equipment from moisture damage. The aftercooler condenses the moisture in the air forming condensation which is then blown through the passages of the aftercooler by flow of the compressed air and deposited in an air storage reservoir connected to the outlet of the aftercooler. The air storage reservoir generally includes a manual and an automatic drain cock through which the accumulated condensation can be expelled.

When the external or ambient air temperature falls below the freezing point of water, the condensate may freeze in the passages of the aftercooler before it can be swept into the reservoir. Such freezing generally occurs if the ambient air temperature falls to about −10° F. in some locomotive applications but may occur at any temperature below the freezing point of water depending on the aftercooler location and efficiency. When this occurs, at least some of the aftercooler passages may become blocked by ice and inhibit the flow of air through the aftercooler and to the air storage reservoir. In such event, there is a risk that the air pressure at the air reservoir may fall to less than that necessary to operate the air brake equipment and force the locomotive to be removed from service. Further, the air supply system includes a pressure relief valve between the aftercooler and air compressor which can be tripped by excess air pressure caused by the reduced air flow through the aftercooler, increasing the risk that the compressor will be unable to supply sufficient air to maintain an operative air brake system. Accordingly, it would be desirable to provide a method and apparatus which overcomes the likelihood of air pressure loss caused by blockage of the aftercooler.

SUMMARY OF THE INVENTION

The present invention provides a method and apparatus which overcomes a loss of air pressure caused by aftercooler blockage; a method and apparatus which maximizes aftercooler air flow until air flow rate is impeded; a method and apparatus which does not adversely affect normal operation of the aftercooler. In an illustrative embodiment, the invention incorporates a bypass system in parallel air flow path with the aftercooler in an air compressor system, the bypass system including a fixed mechanical orifice sized to have a pressure drop thereacross which is greater than the pressure drop across the aftercooler under normal flow conditions so that air flow normally proceeds through the aftercooler with only a small percentage being diverted through the bypass system. Further, the bypass system is so designed that the pressure drop across the orifice is low enough to allow sufficient air flow to supply the volumetric requirements for the locomotive air brake equipment and not cause the back pressure to exceed the safety relief valve trip point. The bypass system is also implemented such that there is sufficient heat from the compressed air exiting the compressor to prevent the orifice from freezing even when all the air flow is diverted through the bypass system.

BRIEF DESCRIPTION OF THE DRAWINGS

For a better understanding of the present invention, reference may be had to the following detailed description taken in conjunction with the accompanying drawing in which.

DETAILED DESCRIPTION OF THE INVENTION

Figure 1:
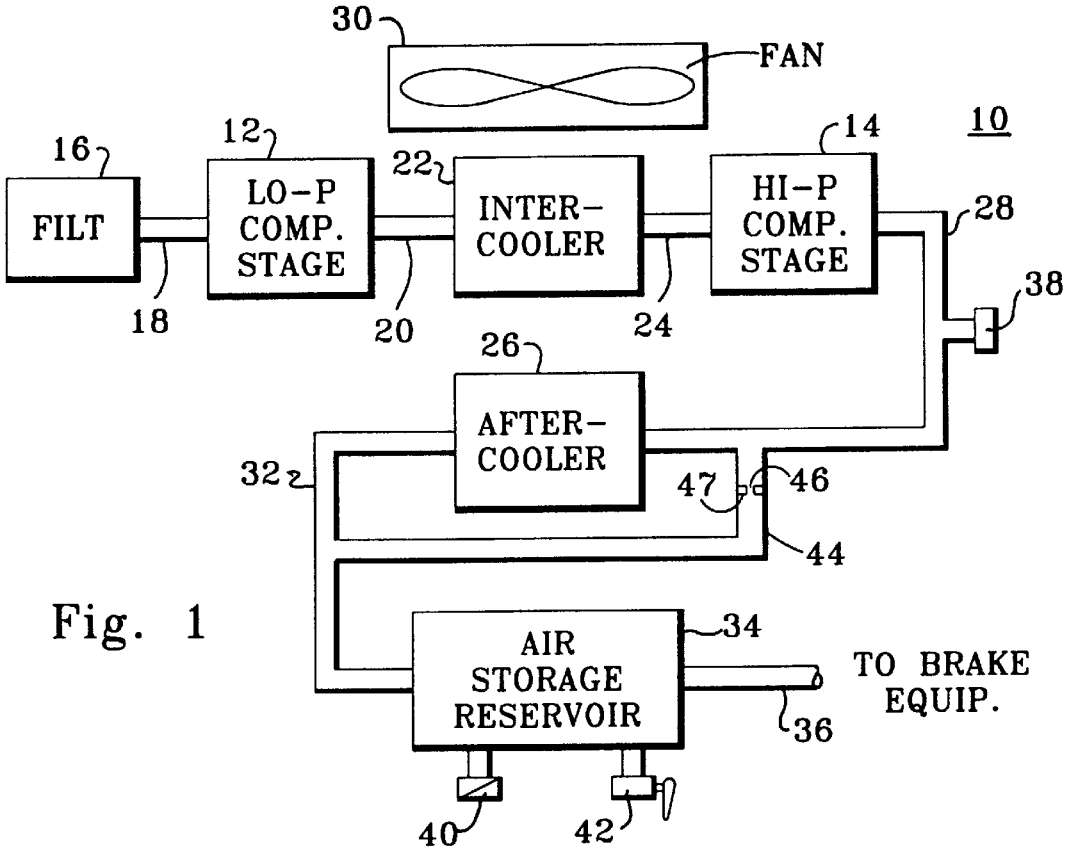
FIG. 1 is a functional block diagram of an air compressor incorporating one implementation of the present invention.

FIG. 1 illustrates in functional block diagram form an air compressor system 10 including a two-stage air compressor comprising a first low pressure stage 12 and a second high pressure stage 14. Air is supplied to the low pressure stage 12 through an inlet filter 16 and air conduit or pipe 18. First stage compressed air is coupled from stage 12 through pipe 20 to an intercooler 22 which reduces the temperature of the compressed air. As is well known, compression of air raises its temperature and it is desirable to supply the second compressor stage 14 with air which is not abnormally hot in order to protect the seals in stage 14, reduce deterioration of the compressor lubricant and improve compressor efficiency. From intercooler 22, the cooled, compressed air is flowed through pipe 24 into second, high pressure stage 14. Compressor stage 14 raises the pressure of the air to a value suitable for supplying the air operated equipment coupled to receive the compressed air. In the illustrative embodiment, the compressor system is useful in a railway locomotive wherein the compressed air is primarily intended for use in operating air brake equipment on the locomotive.

Compressing of the air in compressor stage 14 can raise the temperature of the air to a value that could cause damage to downstream brake equipment. The air also contains elevated levels of moisture which can foul downstream equipment. Accordingly, it is desirable to cool the compressed air as it exits the second compressor stage 14. For this purpose, the system includes an aftercooler 26 coupled to stage 14 via a conduit 28. Both the intercooler 22 and aftercooler 26 are constructed as conventional heat exchangers with the compressed air flowing through a plurality of parallel passages formed by tubing and with external cooling air being forced over the outside surfaces of the tubing by an adjacent fan 30. From the aftercooler, the cooled compressed air is directed via piping 32 into an air storage reservoir 34. Air is then available on demand to supply the brake equipment via outlet conduit 36. Generally, the system 10 includes a pressure relief valve or safety valve 38 coupled to the conduit 28 so as to relieve pressure on the compressor stage 14 in case of a malfunction. Additionally, the reservoir 34 is usually provided with both a manual drain cock 40 and an automatic drain cock 42 for draining the condensate accumulated as a result of cooling the compressed air from compressor stage 14.

All of the elements thus far described are characteristic of prior art air compressor systems. A more detailed description of an exemplary form of such an air compressor system can be had by reference to U.S. Pat. No. 5,106,270.

The present invention is directed to resolution of a problem which occurs when a locomotive or any high pressure air compressor system using an aftercooler is operated in temperatures which are below the freezing temperature of water. In such event, the moisture which condenses from the hot compressed air as it is cooled in the aftercooler 26 can freeze in the tubes of the aftercooler rather than draining into the reservoir 34. When freezing occurs, the tubes become blocked and inhibit the flow of air through the aftercooler. It then becomes possible for the air flow to be so inhibited as to be insufficient to supply the minimum requirements for the air brake system and may require that the locomotive be taken out of service. Further, the blockage increases the air pressure reflected back to the air compressor stage 14 and can cause the safety valve 38 to trip. Still further, with the aftercooler inoperative and air flow inhibited, the compressor temperature may rise to a level that could result in damage to the compressor. The temperature rise at the compressor occurs because the compressor is pumping at higher pressure across the relief valve and can run continuously since the train or locomotive control system will call for more air which is not being delivered because of blockage of the flow path through the aftercooler.

Figure 3:
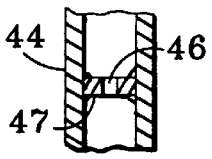
FIG. 3 is an enlarged cross-sectional view of a portion of the system of FIG. 1 showing the fixed orifice.

The present invention overcomes the aftercooler freezing problem by providing an air bypass path around the aftercooler 26 whenever the back pressure at the aftercooler increases above a selected pressure. In particular, there is provided an air conduit 44 connected between air conduit 28 and air conduit 32, essentially in parallel with aftercooler 26. While shown as a separate conduit outside the aftercooler, it is possible to incorporate the bypass into the body of the aftercooler by providing a flow channel around the cooling fins. Within conduit 44 there is installed a fixed orifice 46 which establishes a pressure drop within the conduit. The orifice 46 is a circular hole formed centrally in a plate 47 fixed within the conduit 44 as best seen in the enlarged cross-sectional view of FIG. 3. The orifice 46 is sized to allow the compressor system to operate, under normal conditions, as though the bypass conduit 44 were not present. To achieve this function, the orifice 46 is sized so that the pressure drop thereacross is much higher under normal air flow conditions than the pressure drop across the aftercooler 26 so that the majority of the air flow is through the aftercooler. This assures that the aftercooler 26 will maintain its performance in cooling the compressed air and removing the moisture during the summer months when such cooling and moisture removal is most necessary. The orifice is also sized so that the pressure drop is low enough to allow the air compressor stage 14 to supply the required volumetric flow for the air brake system if the aftercooler 26 is blocked. The sizing of the orifice must also be such that the back pressure is less than the trip set point of safety valve 38. Still further, the orifice 46 must be positioned such that there is sufficient heat from the compressed hot air to prevent the orifice from freezing.

Typically, freezing of the aftercooler 26 does not occur until the ambient air temperature drops to about −10 degrees Fahrenheit, although as previously mentioned, the freezing temperature is related to the location and efficiency of the aftercooler. As ambient conditions moderate, the aftercooler will thaw and air flow will be restored through the aftercooler with only a small bleed of air through the orifice 46, i.e., less than about 10% of the total air flow will be through the orifice under normal operating conditions. However, this percentage depends on the pressure drop across the aftercooler and the safety valve trip point and volumetric flow requirements of the compressor.

Figure 2:
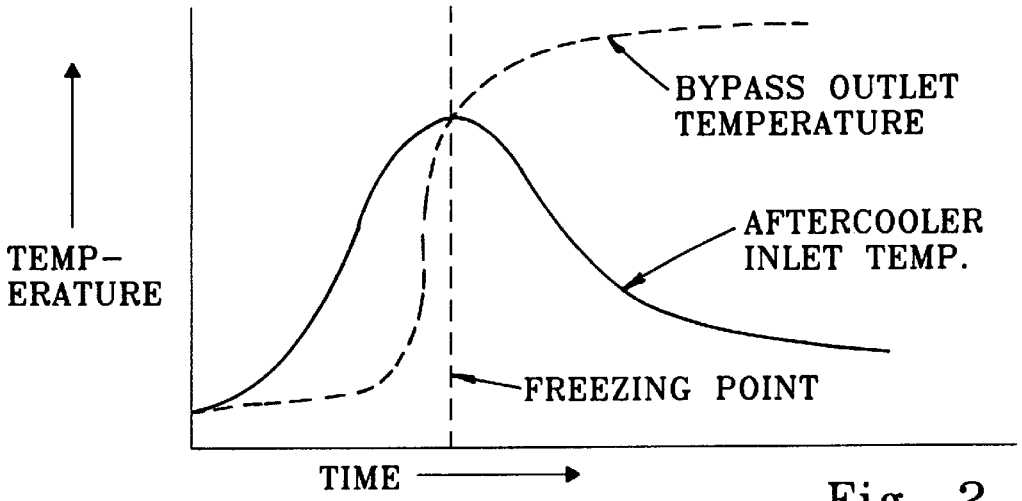
FIG. 2 is a graph illustrating air temperature at the aftercooler and orifice bypass as freezing occurs.

In an exemplary embodiment, the orifice 46 was installed in a two inch diameter conduit with the orifice having a ½ inch opening. With full air flow of 180 scfm, ambient air temperature at −40° F., and compressor air pressure at about 145 psig, the ½ inch orifice kept the pressure well below the trip point of the safety valve 38. Test results showed about a 2% bypass of hot compressed air through the orifice 46 when the aftercooler was not blocked and only resulted in a 2° F. increase in air temperature to the reservoir 34 at full compressor flow. Further, there was a negligible reduction in air flow to the reservoir 34 with the aftercooler 26 fully blocked. With the bypass orifice located within a few inches of the outlet of the compressor stage 14, the temperature at the orifice was maintained well above the freezing temperature of water. Referring to FIG. 2, the graphs of bypass outlet temperature and aftercooler inlet temperature indicate that the bypass outlet temperature increased with increased flow while the aftercooler inlet temperature dropped with decreasing flow. Accordingly, the system functioned to maintain air flow under freezing conditions without the orifice freezing with increased air flow.

While the invention has been described in what is presently considered to be a preferred embodiment, various modifications will become apparent to those skilled in the art. It is intended therefore that the invention not be limited to the precise disclosed embodiment but be interpreted within the full spirit and scope of the appended claims.

What is claimed is:

1. An apparatus for supplying compressed air to air operated equipment, the apparatus including an air compressor, an aftercooler coupled for receiving compressed air for the compressor, a cooling fan for blowing ambient air onto said aftercooler for reducing the temperature of the compressed air whereby moisture in the compressed air forms condensation which is discharged therefrom during normal operation of the aftercooler and which condensation may freeze and block compressed air passages through the aftercooler when ambient air temperature falls below water freezing point, the apparatus including a bypass system for shunting the compressed air from the compressor around the aftercooler when the condensation freezes in the aftercooler passages and blocks air flow therethrough, said bypass system including a fixed orifice of a size selected to create a pressure drop thereacross which is greater than a pressure drop across the aftercooler when air flow through the aftercooler is not inhibited by blockage of the aftercooler passages whereby air flow from the compressor normally passes through the aftercooler and bypasses the bypass system.

2. The apparatus of claim 1 wherein the orifice is sized to provide a pressure drop which allows the compressor from supplying sufficient volumetric air flow to supply the locomotive air operated equipment when the aftercooler is blocked.

3. The apparatus of claim 2 and including an air pressure safety valve connected to an air outlet line of the compressor for releasing air when air pressure exceeds a selected set point, the orifice being sized to have a pressure drop under full flow conditions which is sufficiently low to preclude air pressure at the air outlet line from exceeding the pressure valve set point.

4. The apparatus of claim 3 wherein said orifice in said bypass system is positioned adjacent the air compressor air outlet line whereby the temperature of the compressed air is sufficient to preclude condensation from the compressed air freezing on the orifice.

5. The apparatus of claim 4 wherein said orifice is sized to limit air flow therethrough when said aftercooler is not blocked to less than ten percent of total air flow from said compressor.

6. The apparatus of claim 5 wherein said bypass system includes an air conduit of about two inches in diameter and said orifice comprises a plate positioned inside said air conduit and having a centrally located passage way of about ½ inch diameter.

7. In an air compressor system of the type including a high pressure air compressor and an aftercooler for cooling compressed air exiting from the compressor, the aftercooler effecting heat exchange with the compressed air by a flow of ambient air across the surface of the aftercooler, a method of assuring continued air flow from the compressor when the aftercooler becomes blocked comprising the step of:

providing a bypass air flow system around the aftercooler wherein the bypass air flow system includes a fixed orifice having a pressure drop greater than the pressure drop across the aftercooler such that a minimum volume of air flows through the bypass air flow system under normal system operating conditions.

8. The method of claim 7 and including the further step of positioning the orifice such that heat from the compressed air is sufficient to prevent freezing of the orifice when ambient air temperature is below the freezing point of water.

9. The method of claim 8 wherein the compressor system includes an over pressure safety relief valve and including the step of sizing the orifice such that back pressure at the orifice under full air flow conditions is less than the trip point of the safety relief valve.

10. The method of claim 9 and including the step of sizing the orifice to establish negligible reduction in air flow rate when the aftercooler is fully blocked.

* * * * *